US007261069B2

(12) United States Patent
Gunther

(10) Patent No.: US 7,261,069 B2
(45) Date of Patent: Aug. 28, 2007

(54) ACTIVE DE-AERATION SYSTEM FOR AUTOMOTIVE COOLANT SYSTEMS

(75) Inventor: Alfred A. Gunther, Macomb, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/266,937

(22) Filed: Nov. 4, 2005

(65) Prior Publication Data

US 2007/0101953 A1 May 10, 2007

(51) Int. Cl.
*F01P 3/22* (2006.01)

(52) U.S. Cl. ..... 123/41.54

(58) Field of Classification Search ..... 123/41.54, 123/41.51, 41.1; 165/104.32, 110
See application file for complete search history.

(56) References Cited

U.S. PATENT DOCUMENTS 3,989,103 A * 11/1976 Cieszko et al. ..... 165/110
4,273,563 A * 6/1981 Fadda et al. ..... 96/209

* cited by examiner

*Primary Examiner*—Stephen K. Cronin
*Assistant Examiner*—Hyder Ali

(57) ABSTRACT

An active de-aeration system includes a fill tube, a removable pressure cap, a de-aeration baffle within the fill tube and an externally disposed outlet conduit connected to a sump chamber of the fill tube disposed outside a baffled chamber defined by the de-aeration baffle. The outlet conduit is connected to the coolant system downstream with respect to the fill tube. Air bubbles are actively drawn into the fill tube by coolant movement into the baffled chamber and removably mix with air above a coolant surface in the fill tube.

16 Claims, 3 Drawing Sheets

ACTIVE DE-AERATION SYSTEM FOR AUTOMOTIVE COOLANT SYSTEMS

TECHNICAL FIELD

The present invention relates to coolant systems for internal combustion engines used in automotive applications. More particularly, the present invention relates to an improved de-aeration system for automotive coolant systems.

BACKGROUND OF THE INVENTION

The coolant used for cooling an internal combustion engine is a liquid which is subject to acquiring suspended air bubbles (i.e., aerated coolant) in the course of its flow through various coolant passages within the engine. Since the presence of air bubbles in the coolant is undesirable, as for example it reduces coolant volume and surface contact area for heat transfer and can impede coolant flow, some mechanism is usually provided to promote removal of the air bubbles from the coolant.

FIGS. 1 and 2 depict an exemplification of a passive de-aeration system 10 used in the prior art. An internal combustion engine 12 has a block 14, a head 16, and an associated coolant system 18. The coolant system 18 includes a liquid coolant which flows through a plurality of coolant passages 42 within the block and the head, and connects via coolant lines 44 to a heater core 20, a radiator 22, a thermostat 24 and a pump 26, all components being well known in the automotive arts.

The prior art passive de-aeration system 10 is also a component of the coolant system 18 for removing air bubbles from the coolant. A coolant fill tube 30 is vertically oriented and has at its top end 30*a* a pressure cap 32 which has a twist fit connection to the fill tube. The fill tube 30 is about 150 mm in length L between its top end 30*a* and bottom end 30*b*, and is about 40 mm in diameter D. The pressure cap 32 is of a type well known in the automotive arts, wherein for situations of below a predetermined coolant pressure (for example, around 70 kPa), air escapes through a vent passage 34 in the pressure cap to an overflow nipple 36; however, if pressure exceeds the predetermined pressure, then the internal sealing of the pressure cap is released with respect to an annular cap seal lip 30*c* of the fill tube and coolant 40 can then travel out via the overflow nipple. The bottom end 30*b* of the fill tube 30 opens to a highest elevation coolant passage 42*a* of the plurality of coolant passages 42, as for example at the head 16, such that the fill tube rises vertically at the highest point in the coolant system 18.

In operation, coolant 40 flows (see arrows F) in a coolant passage 42, wherein air bubbles 38 travel in suspension in the coolant and pass below the fill tube 30. Passively, under urge of buoyancy some air bubbles will drift upwardly into the stagnant pool 40*a* of the coolant 40 situated within the fill tube 30. The air bubbles 38 find the surface and merge with the air A thereabove, whereupon the increased pressure caused thereby is released by air passing-out through the vent passage 34.

While the aforedescribed coolant system and its associated de-aeration system provide removal of air bubbles within the coolant, the passive nature of the de-aeration involving a stagnant coolant pool and the passivity of buoyancy, air bubble movement from the coolant passage and into the prior art passive de-aeration system is at a very slow pace, such that the air bubbles must, on average, make very many circuits of the coolant path before successfully finding the fill tube.

Accordingly, what remains needed in the prior art is an active de-aeration system for an automotive coolant system, wherein coolant is actively freed of suspended air.

SUMMARY OF THE INVENTION

The present invention is an active de-aeration system for removing air bubbles in coolant of an automotive coolant system, wherein a portion of the coolant which is most likely laden with a highest density of air bubbles is actively siphoned into the de-aeration system.

The active de-aeration system according to the present invention includes a fill tube and a pressure cap removably connectable thereto, wherein the fill tube further includes a de-aeration baffle therewithin and an externally disposed outlet conduit connected thereto. The outlet conduit is fluidically connected to a sump chamber of the fill tube which is disposed outside a baffled chamber created by the de-aeration baffle. The outlet conduit is also connected to the coolant system externally downstream with respect to the fill tube, most preferably plumbed to the inlet side of the pump.

The de-aeration baffle preferably includes an inverted frustoconical shell situated adjacent the bottom end of the fill tube, and a hollow stem fluidically communicating with a high elevation point of the frustoconical shell. The stem vertically follows, in parallel relation, the fill tube and terminates short of the top end thereof so that coolant may flow thereout and into the sump chamber. Preferably, a baffle orifice is provided in the stem, most preferably at a lower end of the stem, adjacent the frustoconical shell.

In operation, flowing coolant has a portion thereof which is most laden (densely populated) with air bubbles, this being located at a highest elevation of the coolant passage whereat the fill tube openingly interfaces therewith. Since the outlet conduit creates a negative coolant pressure at the bottom end of the fill tube, the pressure differential with respect to the coolant in the coolant passage causes the aforementioned upper layer of coolant in the highest elevation portion of the coolant passage which is most densely populated with air bubbles (most aerated) to be suckingly siphoned into the fill tube. As the siphoned coolant passes through the de-aeration baffle and then passes into the more slowly moving coolant sump, the air bubbles therein buoyantly make their way to the air above the surface of the flowing coolant in the sump chamber, whereupon excess air exits through the vent passage of the pressure cap.

Thus, it is seen that the coolant most laden with air bubbles in the coolant passage is actively drawn into the active de-aeration system, whereafter the air bubbles buoyantly ascend and make their way out of the coolant, whereupon the coolant flowing out the outlet conduit is de-aerated, and whereupon the coolant flowing out of the coolant passage (that proportion of the coolant not going through the de-aeration system) is greatly depopulated of air bubbles.

Accordingly, it is an object of the present invention to provide an active de-aeration system for an automotive coolant system.

This and additional objects, features and advantages of the present invention will become clearer from the following specification of a preferred embodiment.

DESCRIPTION OF THE PREFERRED EMBODIMENT

Figure 1:
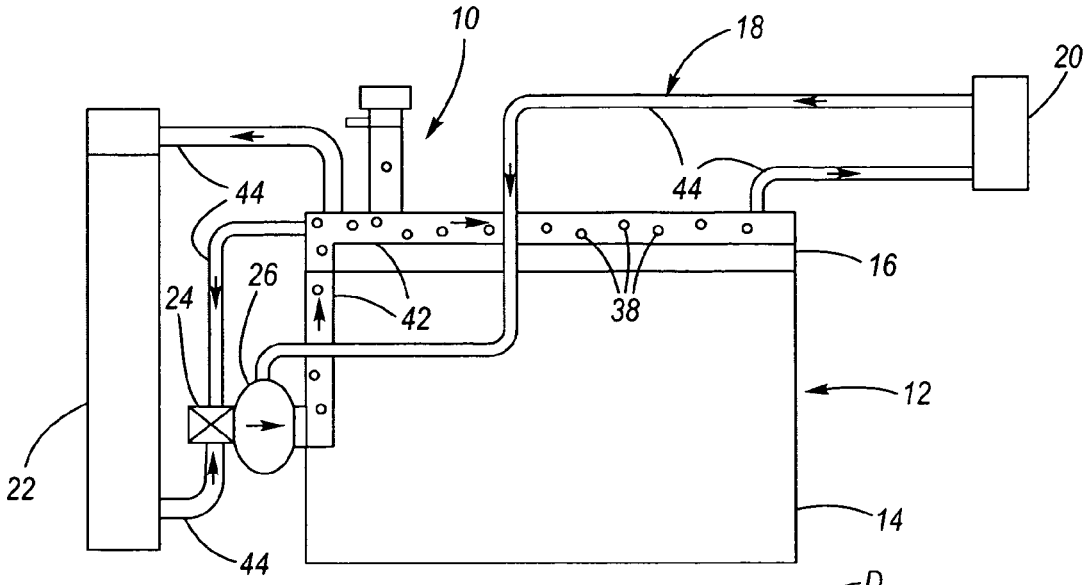
Prior Art Fig. 1
FIG. 1 is a schematic view of a prior art automotive coolant system, including a prior art passive de-aeration system.

Referring now to the drawing, FIGS. 3 through 7 depict an example of an active de-aeration system 100 for an automotive coolant system according to the present invention.

Figure 3:
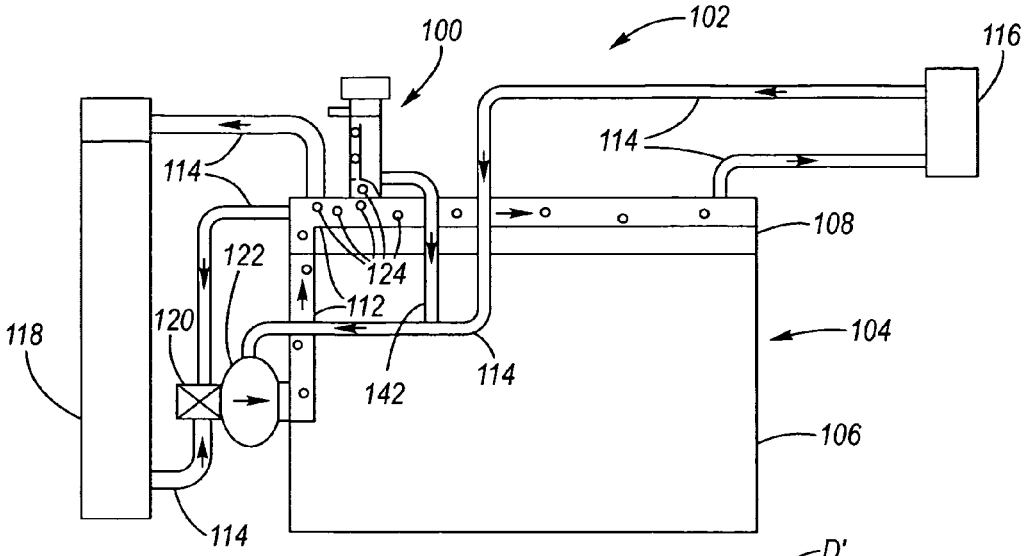
FIG. 3 is a schematic view of an automotive coolant system, including an active de-aeration system according to the present invention.
Figure 4:
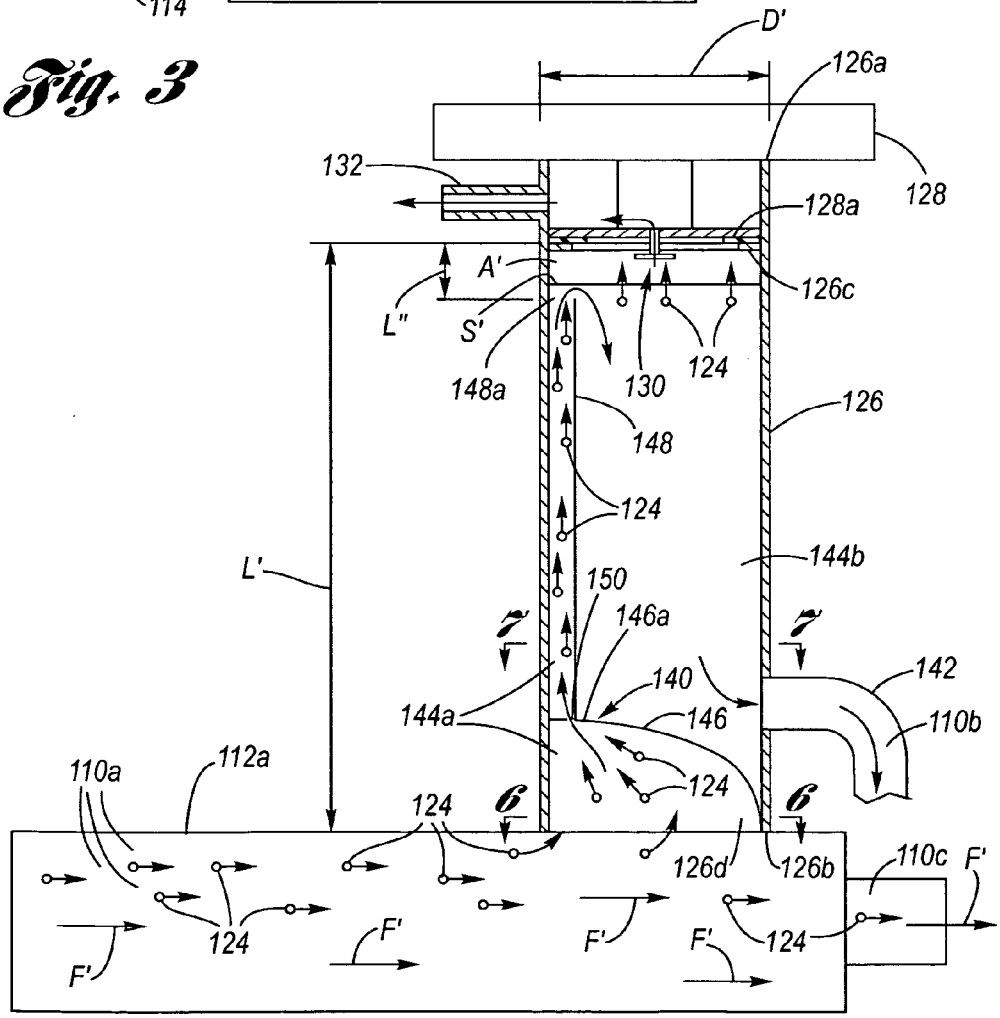
FIG. 4 is a sectional side view of the active de-aeration system of FIG. 3.
Figure 5A:
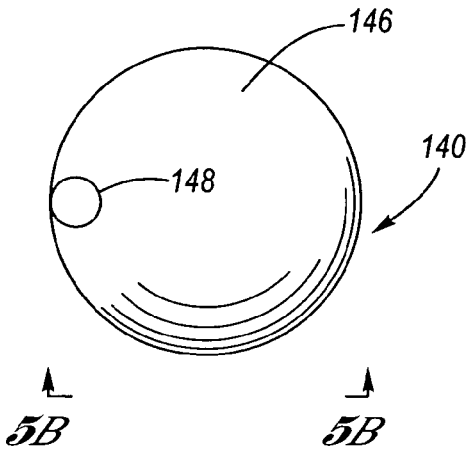
FIG. 5A is a top plan view of a de-aeration baffle of the de-aeration system according to the present invention.
Figure 5B:
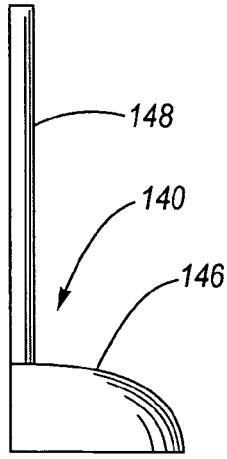
FIG. 5B is a side view, seen along lines 5B-5B of FIG. 5A.
Figure 6:
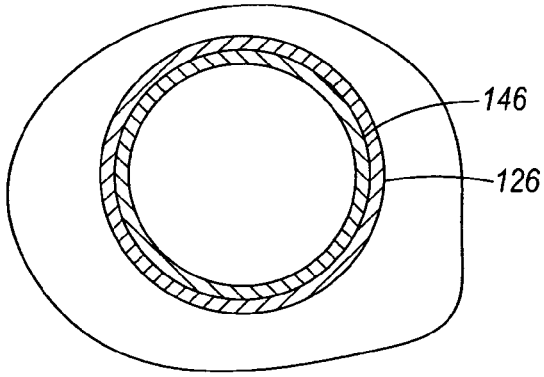
FIG. 6 is a partly sectional view seen along line 6-6 of FIG. 4.
Figure 7:
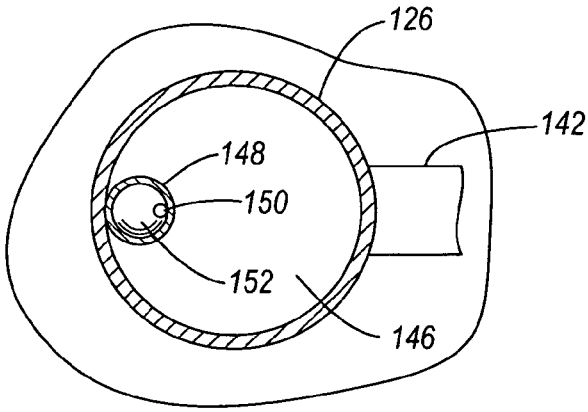
FIG. 7 is a partly sectional view seen along line 7-7 of FIG. 4.

As depicted at FIGS. 3 and 4, the active de-aeration system 100 forms a component of an automotive coolant system 102 for an internal combustion engine 104. The internal combustion engine 104 includes, typically, a block 106 and a head 108, as well as the aforementioned coolant system 102. The coolant system 102 includes a liquid coolant 110 which flows through coolant passages 112 within the block and the head, and connects via coolant lines 114, typically to a heater core 116, a radiator 118, a thermostat 120 and a pump 122.

The active de-aeration system 100 serves as a component of the coolant system 102 for removing air bubbles 124 from the coolant 110. A coolant fill tube 126 is vertically oriented and has at its top end 126*a* a removable pressure cap 128 which has, preferably, a twist fit connection to the fill tube and, via a resiliently biased elastomeric portion 128*a* thereof, seals on an annular cap seal lip 126*c* of the fill tube. The fill tube 126 is about 150 mm in length L' between its bottom end 126*b* and the cap seal lip 126*c*, and is about 40 mm in diameter D'.

Figure 2:
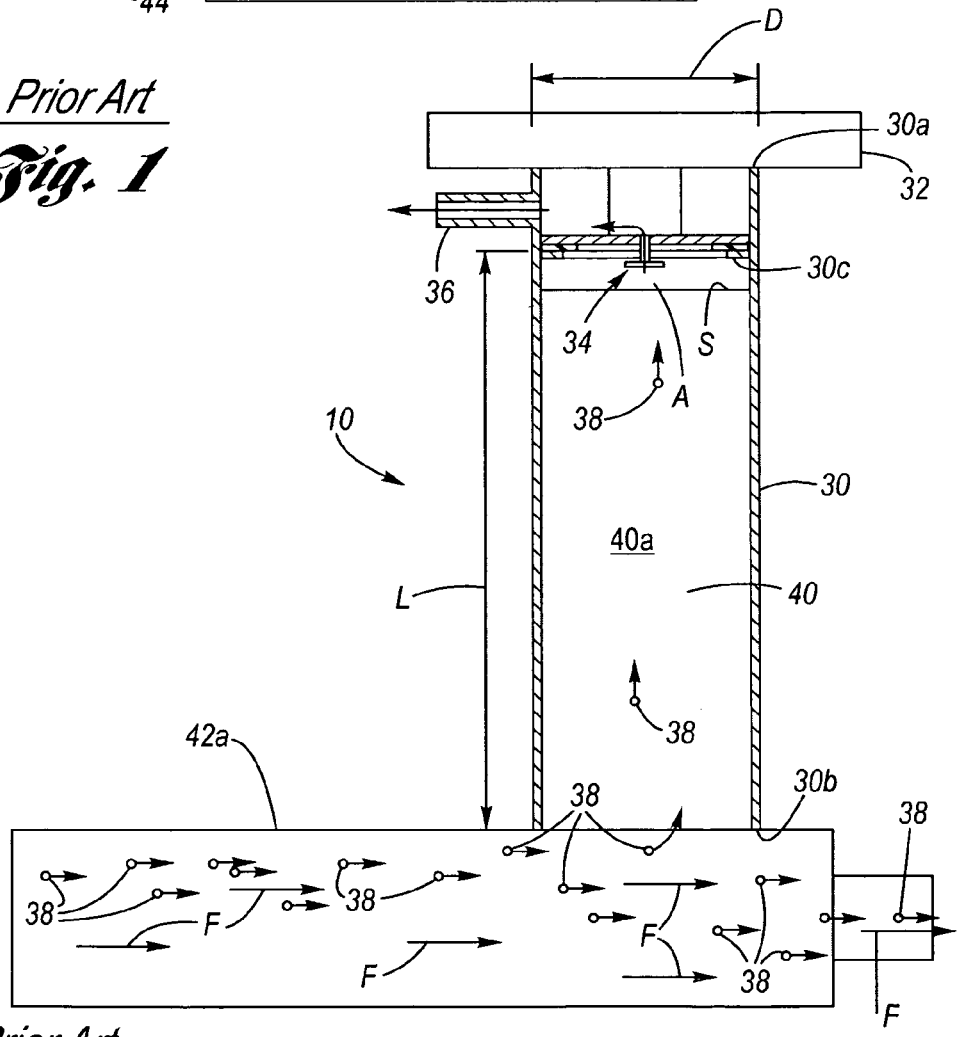
Prior Art Fig. 2
FIG. 2 is a sectional side view of the prior art passive de-aeration system of FIG. 1.

The pressure cap 128 is preferably conventional and of the type discussed hereinabove with respect to FIGS. 1 and 2, wherein for situations of below a predetermined coolant pressure (for example, around 70 kPa), air escapes through a vent passage 130 in the pressure cap to the overflow nipple 132; however, if pressure exceeds the predetermined pressure, then the internal sealing of the pressure cap is released and coolant can travel out via the overflow nipple. The bottom end 126*b* of the fill tube 126 opens to a coolant passage 112, most preferably at the head 108, such that the fill tube rises vertically at the highest point of the coolant system 102.

Referring now additionally to FIGS. 5A through 7, the active de-aeration system 100 includes the aforementioned fill tube 126 and pressure cap 128 therefor, wherein the fill tube additionally includes a de-aeration baffle 140 within the fill tube and an outlet conduit 142, as for example a hose, which is fluidically interfaced with the fill tube.

The de-aeration baffle 140 establishes two separated coolant chambers within the fill tube 126: a baffled chamber 144*a* and a sump chamber 144*b*, wherein the baffled chamber is internal to the de-aeration baffle and internal to the fill tube, and wherein the sump chamber is external to the de-aeration baffle and internal to the fill tube. The outlet conduit 142 is connected at its inlet end to the fill tube 126 at the sump chamber 144*b*, and connected at its outlet end to the coolant system 102 downstream of the fill tube, preferably by plumbing to the inlet side of the pump 122 so as to create a low coolant pressure, for example 35 kPa, at the sump chamber 144*b* in relation to the nominal coolant pressure, for example 70 kPa, in the coolant passage 112 whereat the bottom end 126*b* of the fill tube 126 interfaces.

The de-aeration baffle 140 is characterized by an inverted frustoconical shell (i.e., a shell having an inverted funnel shape) 146, situated adjacent the bottom end 126*b* of the fill tube 126, and a hollow (straw-like) stem 148 of about 6 mm diameter which is sealingly connected with (preferably by being integral therewith), and communicates fluidically with the highest elevation point 146*a* of the frustoconical shell. The stem 148 vertically follows, in parallel relation, the fill tube 126 and terminates in an open stem top end 148*a* that is spaced a distance L" of about 15 mm from the cap seal lip 126*c*.

A baffle orifice 150 of about 2 mm diameter is provided via a baffle diaphragm 152 (see FIG. 7) in the stem 148 most preferably disposed adjacent the frustoconical shell 146. The baffle orifice 150 is less than one-half the internal diameter of the stem, preferably less than about one-third, so as to thereby provide metering of the rate at which coolant flows through the de-aeration system, wherein the coolant flow is relatively fast in the baffled chamber 144*a* and relatively slow in the sump chamber 144*b*.

In operation, coolant 110 flows (see arrows F') in a selected highest elevation coolant passage 112*a*, wherein the coolant is most densely laden with air bubbles 124 at a high-elevation portion layer 110*a* thereof, and whereat the fill tube openingly interfaces therewith so as to ensure a highest density of aerated coolant is exposed to the opening 126*d* of the fill tube 126. In this regard, a highest elevation passage is preferably selected for interface with the fill tube. Since the outlet conduit 142 creates a negative coolant pressure at the sump chamber 144*b*, and as a consequence, at the fill tube opening 126*d*, the pressure differential thereby established causes the upper layer 110*a* of the coolant, the most densely aerated portion of the coolant, to be suckingly siphoned into the fill tube. As the aerated coolant passes through the baffled chamber 144*a*, by metering through the baffle orifice 140, and passes out of the stem 148 at the open stem end 148*a* into the more slowly moving coolant sump 144*b*. The air bubbles buoyantly move in the coolant and exit therefrom at its surface S' so as to thereby mix with the air A'above the surface. Thereupon, excess air exits through the vent passage 130 of the pressure cap 128.

As a result of the active nature of operation of the active de-aeration system 100 according to the present invention, the coolant most laden with air bubbles in the coolant passage is actively drawn into the active de-aeration system, whereafter the air bubbles 124 buoyantly ascend and make their way out of the coolant, whereupon the fraction of the coolant 110*b* flowing out the outlet conduit 142 is de-aerated, and whereupon the fraction of the coolant 110*c* flowing out of the coolant passage (the portion of the coolant not going through the de-aeration system) is greatly depopulated of air bubbles.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A de-aeration system for a coolant system of an internal combustion engine, comprising:

a sump chamber having a bottom end;

a de-aeration baffle disposed above an interface with aerated coolant of a coolant system, said de-aeration baffle defining a baffled chamber internal to said de-aeration baffle, said sump chamber being disposed adjacently external to said de-aeration baffle; said de-aeration baffle comprising:

a shell disposed adjacent said bottom end of said sump chamber;

a hollow stem connected to said shell, wherein said stem fluidically communicates with said shell; and a baffle orifice located in said stem, wherein said orifice has an orifice diameter and said stem has a stem internal diameter, and wherein said orifice diameter is less than one-half the stem internal diameter; and an outlet conduit in fluidic communication with said sump chamber, said outlet conduit being adapted to connect with the coolant system downstream of said sump chamber;

wherein coolant of the coolant system enters said baffled chamber, passes into said sump chamber and thereupon exits, via said outlet conduit, back to the coolant system, wherein air bubbles suspended in the coolant at said baffled and sump chambers mix with air above a surface of the coolant and thereupon exit said said baffled and sump chambers.

2. The de-aeration system of claim 1, wherein said de-aeration baffle further comprises:

said shell being frustoconically shaped and being disposed in inverted relation to said sump chamber, said shell having a highest elevation in relation to said sump chamber; and said stem being connected to said shell substantially at said highest elevation thereof, wherein said stem fluidically communicates with said shell.

3. The de-aeration system of claim 2, further comprising a fill tube, said de-aeration baffle and said sump chamber being disposed in said fill tube, wherein said fill tube has a top end; further comprising:

a pressure cap removably connected to said top end of said fill tube, said pressure cap having a vent passage for allowing air to vent therethrough out of said fill tube;

wherein said stem has an open end which terminates in spaced relation with respect to said pressure cap.

4. A coolant system for an internal combustion engine, comprising:

a plurality of coolant passages disposed in the internal combustion engine;

a liquid coolant in said coolant passages; and a de-aeration system, comprising:

a fill tube having an open bottom end fluidically interfaced with aerated coolant of a selected coolant passage of the coolant system;

a de-aeration baffle disposed within said fill tube above the interface with the aerated coolant, said de-aeration baffle defining a baffled chamber internal to said de-aeration baffle and internal to said fill tube, said de-aeration baffle further defining a sump chamber external to said de-aeration baffle and internal to said fill tube; said de-aeration baffle comprising:

a shell disposed at said bottom end of said fill tube;

a hollow stem connected to said shell, wherein said stem fluidically communicates with said shell; and a baffle orifice located in said stem, wherein said orifice has an orifice diameter and said stem has a stem internal diameter, and wherein said orifice diameter is less than one-half the stem internal diameter; and an outlet conduit connected to said fill tube in fluidic communication with said sump chamber, said outlet conduit being connected with the coolant system downstream of said fill tube;

wherein said coolant enters said baffled chamber, passes into said sump chamber and thereupon exits, via said outlet conduit, back to the coolant system, wherein air bubbles suspended in the coolant at said baffled and sump chambers mix with air above a surface of the coolant within the fill tube and thereupon exit said fill tube.

5. The coolant system of claim 4, further comprising a pump fluidically connected with said coolant passages, wherein said pump pumps said coolant through said coolant passages; wherein said outlet conduit is plumbed to an inlet side of said pump.

6. The coolant system of claim 4, wherein said selected coolant passage comprises substantially a highest elevation of said plurality of coolant passages.

7. The coolant system of claim 4, wherein said de-aeration baffle further comprises:

said shell being frustoconically shaped and being disposed at said bottom end of said fill tube in inverted relation thereto, said shell having a highest elevation in relation to said bottom end of said fill tube; and said stem being connected to said shell substantially at said highest elevation thereof, wherein said stem fluidically communicates with said shell.

8. The coolant system of claim 7, wherein said fill tube has a top end, further comprising:

a pressure cap removably connected to said top end of said fill tube, said pressure cap having a vent passage for allowing air to vent therethrough out of said fill tube;

wherein said stem has an open end which terminates in spaced relation with respect to said pressure cap.

9. The coolant system of claim 8, further comprising a pump fluidically connected with said coolant passages, wherein said pump pumps said coolant through said coolant passages; wherein said outlet conduit is plumbed to an inlet side of said pump.

10. The coolant system of claim 9, wherein said selected coolant passage comprises substantially a highest elevation of said plurality of coolant passages.

11. A coolant system for an internal combustion engine, comprising:

a plurality of coolant passages disposed in the internal combustion engine;

a liquid coolant in said coolant passages; and a de-aeration system, comprising:

a fill tube having an open bottom end fluidically interfaced with aerated coolant of a selected coolant passage of the coolant system;

a de-aeration baffle disposed within said fill tube above the interface with the aerated coolant, said de-aeration baffle defining a baffled chamber internal to said de-aeration baffle and internal to said fill tube, said de-aeration baffle further defining a sump chamber external to said de-aeration baffle and internal to said fill tube; and an outlet conduit connected to said fill tube in fluidic communication with said sump chamber, said outlet conduit being connected with the coolant system downstream of said fill tube;

wherein said coolant enters said baffled chamber, passes into said sump chamber and thereupon exits, via said outlet conduit, back to the coolant system, wherein air bubbles suspended in the coolant at said baffled and sump chambers mix with air above a surface of the coolant within the fill tube and thereupon exit said fill tube; and wherein said selected coolant passage comprises substantially a highest elevation of said plurality of coolant passages.

12. The coolant system of claim 11, further comprising a pump fluidically connected with said coolant passages, wherein said pump pumps said coolant through said coolant passages; wherein said outlet conduit is plumbed to an inlet side of said pump.

13. The coolant system of claim 11, wherein said baffle comprises:

a frustoconically shaped shell disposed at said bottom end of said fill tube in inverted relation thereto, said shell having a highest elevation in relation to said bottom end of said fill tube; and a hollow stem connected to said shell substantially at said highest elevation thereof, wherein said stem fluidically communicates with said shell.

14. The coolant system of claim 13, further comprising a baffle orifice located in said stem, wherein said orifice has an orifice diameter and said stem has a stem internal diameter, and wherein said orifice diameter is less than one-half the stem internal diameter.

15. The coolant system of claim 14, wherein said fill tube has a top end, further comprising:

a pressure cap removably connected to said top end of said fill tube, said pressure cap having a vent passage for allowing air to vent therethrough out of said fill tube;

wherein said stem has an open end which terminates in spaced relation with respect to said pressure cap.

16. The coolant system of claim 15, further comprising a pump fluidically connected with said coolant passages, wherein said pump pumps said coolant through said coolant passages; wherein said outlet conduit is plumbed to an inlet side of said pump.

* * * * *